United States Patent [19]

Kristensen

[11] Patent Number: 4,480,631

[45] Date of Patent: Nov. 6, 1984

[54] APPARATUS FOR DELIVERING HEATED FLUID MEDIUM

[76] Inventor: Henning Kristensen, 12 Mitchell Ave., East Brunswick, N.J. 08816

[21] Appl. No.: 439,304

[22] Filed: Nov. 4, 1982

[51] Int. Cl.[3] ..... F24H 1/20

[52] U.S. Cl. ..... 126/360 R; 126/362; 126/367; 126/368; 126/365; 122/20 A; 122/20 B; 122/44 A; 122/155 A; 122/183

[58] Field of Search ..... 126/362, 365, 360 R, 126/366, 367, 368; 122/18, 20 B, 20 A, 20 R, 44 A, 90, 132, 48, 150, 155 A, 169, 174, 183; 165/DIG. 2, DIG. 12, 130, 154, 1; 237/56, 57, 59

[56] References Cited

U.S. PATENT DOCUMENTS

| | | | |
|---|---|---|---|
| 138,607 | 5/1873 | Brightman . | |
| 406,727 | 7/1889 | Hacker et al. | 126/360 R |
| 877,115 | 1/1908 | Patterson . | |
| 1,295,610 | 2/1919 | Schwartz . | |
| 1,616,143 | 2/1927 | Schnepp | 122/183 X |
| 1,633,758 | 6/1927 | Birtch | 122/18 X |
| 2,262,153 | 11/1941 | Wykes et al. | 122/155 A |
| 2,656,821 | 10/1953 | Ray | 122/150 |
| 2,904,014 | 9/1959 | Meyers | 122/169 X |
| 4,079,778 | 3/1978 | Trump | 165/1 |
| 4,251,028 | 2/1981 | Nicolai et al. | 237/8 R |
| 4,360,003 | 11/1982 | Hardy | 126/368 |

FOREIGN PATENT DOCUMENTS

| | | | |
|---|---|---|---|
| 57704 | 6/1940 | Denmark | 126/366 |
| 20813 | 11/1910 | Norway | 126/365 |
| 189093 | 10/1936 | Switzerland | 126/368 |

*Primary Examiner*—Randall L. Green
*Attorney, Agent, or Firm*—James J. Daley

[57] ABSTRACT

Apparatus for delivering hot water includes a vessel for releasably containing water and a heat generator compartment in heat transfer relation to the vessel. A conduit in the vessel circumscribes the exhaust funnel of the heat generator and has an inlet port in fluid communication with the vessel and an outlet port in fluid communication with the exterior of the vessel. An after-burner may be situated in the exhaust funnel in registry with the conduit and the conduit can be a coil arranged in spiral configuration.

5 Claims, 2 Drawing Figures

APPARATUS FOR DELIVERING HEATED FLUID MEDIUM

FIELD OF THE INVENTION

This invention relates generally to apparatus for supplying heated fluid medium and pertains more particularly to apparatus for controlled rate delivery of hot water for degreasing and like purposes.

BACKGROUND OF THE INVENTION

In long known practices for supplying hot water, a casing has a first compartment which houses a tank fed with cold tap water and the casing includes a second compartment housing both a heater of fossil fuel burning type and a water conduit. The conduit is in fluid-flow communication with the water tank for receiving water to be heated and also with casing outlet piping serving a consumer. In present day apparatus, the heater is typically a fuel-fired burner and the water conduit is coiled upwardly in spiral configuration in the path of issuance of the burner flame and therebeyond toward the heater exhaust funnel or stack.

Various disadvantages attend this commonly known non-portable and bulky apparatus with its customized heater and coil compartment, particularly where one seeks a portable, relatively small and inexpensive hot water supply unit for use such as is made in local auto repair shops, e.g., in the degreasing of engines prior to tune-up and other repair activities. In that field of endeavor, degreasing of engines is desirable from the points of view of facilitating the work of the mechanic and extending the lifetimes of hoses and other engine parts contaminated by grease buildup.

The conflicting industrial demands of, on the one hand, having a light-weight, portable and inexpensive apparatus and, on the other hand, having apparatus with the capability of furnishing promptly a continuous supply of degreasing fluid have not been accomodated, in applicant's view, in heretofore known apparatus.

SUMMARY OF THE INVENTION

The present invention has as its primary object the provision of simple and inexpensive apparatus for readily meeting the conflicting industrial demands above noted.

In attaining this and other objects, apparatus is provided by the invention for delivering heated fluid medium such as water, the apparatus comprising: a vessel for containing the fluid medium; a heat generator compartment in heat transfer relation to the vessel and having an exhaust or output heat funnel extending through the vessel; and a conduit supporting flow of the fluid medium, the conduit circumscribing the exhaust funnel at a location exterior to the heat generator compartment, having an inlet port in fluid communication with the vessel and having an outlet port in fluid communication with the exterior of the vessel for delivery of heated fluid medium.

In its disposing of the fluid medium flow conduit exteriorly of the heat generator compartment, the invention affords both simplicity of the heat generator, i.e., permits use of standard heater generator, and isolates the medium flow conduit from the deleterious direct impact thereon of flame and combustion products.

The flow conduit is preferably arranged in a descending spiral about an upstanding exhaust funnel and the conduit inlet port is situated to receive fluid medium from the upper portion of a self-draining type of vessel, whereby the conduit is also self-draining, thus facilitating use of the apparatus in environments in which the fluid medium is subject to freezing if the apparatus remains idle.

The foregoing and other objects and features of the invention will be further evident from the following detailed description of apparatus and practices in accordance with the invention and from the drawings wherein like reference numerals identify like parts throughout.

DESCRIPTION OF PREFERRED EMBODIMENTS AND PRACTICES

Figure 1:
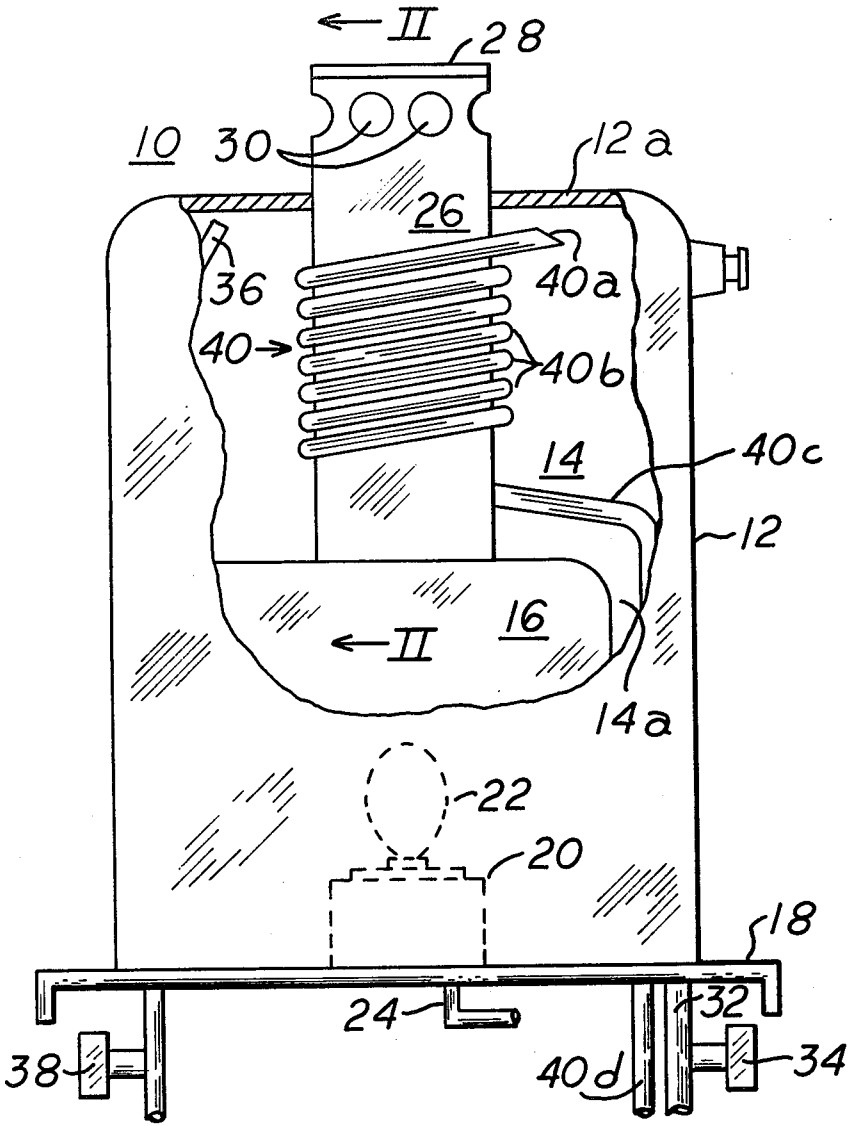
FIG. 1 is a front elevational view of apparatus in accordance with the invention, the casing thereof being broken away in part to show interior detail.

Referring to FIG. 1, apparatus 10 includes an upstanding casing or shell 12 having a wall **12*a* bounding a compartment defining a fluid medium vessel or tank 14 for releasably containing the medium. Also situated within casing 12 is a heat generator compartment 16. Members 12 and 16 are secured, as by welding, to base plate 18. Preferably, casing 12 and compartment 16 are cylindrical with the latter being of such lesser diameter and height than the former as to define a cylindrical extension 14*a* of tank 14 extending to base plate 18**. The tank thereby encircles the heater compartment to increase heat transfer thereto.

Interiorly of heater compartment 16 is a heat generator comprised of diesel oil burner 20, of customary construction, which issues flame 22 when fueled through line 24. Omitted from the drawings as generally known are customary fuel supply-regulating controls for line 24.

An exhaust or output heat funnel 26 is in flow communication with compartment 16 and extends through tank 14, being suitably sealed at its passage through wall **12*a* and at its exit from compartment 16 through compartment wall 16*a* (FIG. 2) to preclude issuance of combustion products into tank 14. At its upper extremity distal from compartment 16, funnel 26 includes exhaust issuance openings 30 about its circumference and has an open end closed by lid 28**.

Cold tap water is fed through inlet pipe 32 to tank 14, a safety valve and quarter-turn ball valve unit 34 being associated with inlet pipe 32. A bleeder pipe 36 is arranged with its inlet **36*a* in close proximity to the upper course of wall 12*a* as indicated and exits tank 14 beyond base plate 18, a safety valve and quarter-turn ball valve unit 38** also being associated with the bleeder pipe.

A coil assembly, comprising the aforementioned fluid medium flow conduit and generally designated at 40, includes an inlet port **40*a* in communication with tank 14, a plurality of successive spiral courses 40*b* inclined downwardly, an exit from spiral course 40*c* and an outlet course 40*d* extending beyond base plate 18. In circumscribing funnel 26, spiral courses 40*b* are contiguous with funnel 26 to facilitate conductive heat transfer from funnel 26 to coil assembly 40. The funnel is elongate and courses 40*b* each form an acute angle with the funnel longitudinal axis. In this preferred plural cylinder embodiment, it will be seen that bleeder pipe 36 and coil assembly 40 each include a course extending downwardly past heater compartment 16 to base plate 18. On the other hand, inlet pipe ends at base 18 to insure complete self-draining capability for compartment 14. Further, inlet 36***a* of pipe 36 is disposed upwardly of inlet 40*a* of coil assembly 40, such that pipe 36, and not assembly 40, bleeds air from tank 14.

Figure 2:
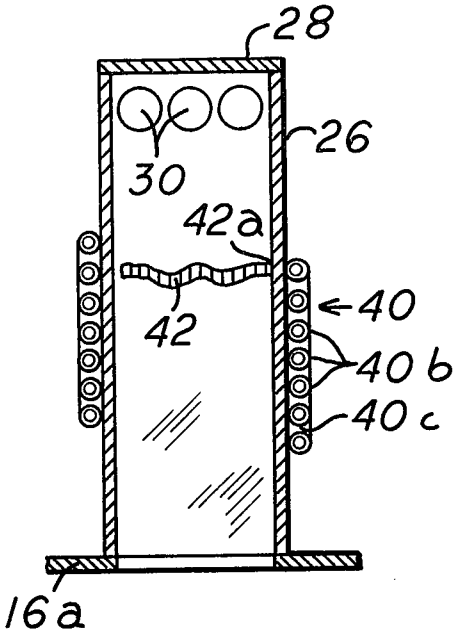
FIG. 2 is a sectional illustration of the exhaust funnel and coil assembly of the FIG. 1 apparatus as seen from plane II—II thereof.

Referring to FIG. 2, a heat-conductive member 42 extends across funnel 26, approximately centrally of coil assembly 40. In preferred practice, member 42 is secured to funnel 26 at three equidistant locations (one being indicated at 42*a*) on the perimeter of member 42 and the member, which may be a sheet metal stamping, may take on an undulating configuration transversely of funnel 26, as indicated. As is discussed below in connection with the operation of the apparatus, member 42 serves plural purposes, namely, to uniformly concentrate heat in the vicinity of coil assembly 40 and to provide an after-burner for unburned fuel issuing in funnel 26.

By way of example, burner 20 may be a diesel oil fired, forced-draft burner with a one to one and one-half gallon per hour fuel consumption rate. Nozzle 20 may be a semi-solid member mounted vertically, i.e., aligned with funnel 26. Compartment 16 is cylindrical, having an inner diameter of thirteen inches and a height above base plate 18 of twenty five inches. A circular opening centrally in wall 16*a* measures four and one-half inches for outlet to funnel 26. The funnel itself is six inches in outside diameter and has a height of sixteen inches above compartment 16. Openings 30 may comprise nine holes, each of one and one-half inches in diameter. The catalytic deflector-concentrator member 42 may measure four and one-half inches in diameter and is located some eight inches from the top of funnel 26. Member 42 has a perimeter clearance of five-eights inch from the interior funnel wall, except for the three locations at which member 42 is welded to such wall. The funnel is covered with a thirteen-gauge plate and the coil assembly is wrapped tightly spirally about the plate, inlet 40*a* being at a forty five degree angle from the vertical. Five-eighths inch light tubing is used as coil assembly 40. A high temperature limit switch 44 is placed about one inch from the top of shell 12.

In use of the apparatus described, a pressure pump 46 with issue nozzle 48 is connected to coil assembly outlet course 40*d*. Valve unit 34 is opened and cold tap water is introduced into tank 14 through line 32. Valve unit 38 is likewise opened to bleed air in the course of tank filling. As the tank becomes filled, water will exit the tank both through bleeder line 36 and through coil assembly 40 and, at this juncture, valve units 34 and 38 are both closed. Burner 20 is fired to transfer heat to the contained water and clean combustion is effected by catalytic member 42. When water temperature in tank 14 reaches a preselected temperature, e.g., one hundred eighty degrees F., high temperature limit switch 44 is operative to turn off burner 20.

The pressure pump is now operated and valve unit 34 is concurrently opened to provide for continuous flow into tank 14 under pressure, e.g., forty-five psi. Inlet water now surges upwardly in tank 14 and the upper contents of the tank are discharged through coil assembly 40, member 42 providing sufficiently high heat concentration to maintain water temperature at outlet course 40*d* at approximately one hundred and sixty five degrees F. under constant pump output flow of about one and eight-tenths to two gallons per minute.

Use of member 42 provides for a cleaner burn and enhances uniformity of flow and uniformity of heating. Its perimetric configuration tracks the cross-sectional configuration of funnel 26. Thus, where the funnel is circular, as shown, member 42 is likewise circular at its perimeter and of slightly less diameter. Within its perimeter, member desirably takes on a configuration providing for increased surface area over that which would be provided by a flat plate, e.g., the increased surface area provided by the the undulated version of member 42 in FIG. 2. In another suitable configuration, member 42 could be conical interiorly of its funnel tracking perimeter with the apex of the cone pointed toward the burner. Member 42 is of solid material throughout, such as carbon steel or stainless steel.

Various changes in structure and modifications in practice may evidently be introduced in the foregoing particularly disclosed and described embodiments and practices without departing from the invention. Thus, such matters as apparatus configuration, coil assembly inclination, apparatus orientation and the like will be seen to be readily varied. By the term "funnel" is meant structure which is disposed between the burner and the fluid medium tank and is heated by the burner and assists in exhausting the flame and combustion products thereof. Thus, coil assembly 40 may be disposed in circumscribing relation to compartment 16 as opposed to its illustrated disposition about the stack portion of funnel 26. The preferred embodiments and practices are thus intended in an illustrative and not in a limiting sense. The true spirit and scope of the invention is set forth in the following claims.

I claim:

1. Apparatus for delivering heated fluid medium, comprising:

(a) an upstanding casing;

(b) a first compartment in said casing;

(c) a heat generator in said first compartment;

(d) a second compartment in said casing formed by the outer surface of said first compartment and upper interior surface of said casing for releasably containing said medium;

(e) an output heat funnel communicating with and extending from said first compartment through said second compartment and exiting said casing;

(f) conduit means having an inlet port in the vicinity of said upper interior surface of said second compartment for receiving said medium therein, said conduit means circumscribing said funnel in said second compartment and having an outlet port issuing exteriorly of said casing and disposed vertically below said inlet port, said conduit means being disposed exteriorly of said first compartment; and (g) means disposed in said funnel and in registry with said second compartment for after-burning of combustion products of said heat generator in said funnel.

2. The apparatus claimed in claim 1 wherein said after-burning means (g) is a sheet metal member having an undulating configuration transversely of said funnel.

3. The apparatus claimed in claim 1 wherein said casing is an upstanding cylindrical casing, said first compartment being an upstanding cylindrical compartment of height and diameter less than the height and diameter of said casing, said second compartment, thus encircling said first compartment.

4. The apparatus claimed in claim 1 wherein said conduit means comprises a coil having plural courses successively circumscribing said funnel.

5. The apparatus claimed in claim 4 wherein said funnel is upstanding, wherein said coil is a downwardly extending spiral and wherein said conduit means is self-draining.

* * * * *